US006877643B2

(12) United States Patent
Schneider

(10) Patent No.: US 6,877,643 B2
(45) Date of Patent: Apr. 12, 2005

(54) AEROSOL CAN

(75) Inventor: Heinz Schneider, Langenselbold (DE)

(73) Assignee: Thomas GmbH, Langenselbold (DE)

( * ) Notice: Subject to any disclaimer, the term of this patent is extended or adjusted under 35 U.S.C. 154(b) by 54 days.

(21) Appl. No.: 10/362,544

(22) PCT Filed: Aug. 3, 2001

(86) PCT No.: PCT/EP01/09001

§ 371 (c)(1),
(2), (4) Date: Feb. 25, 2003

(87) PCT Pub. No.: WO02/18234

PCT Pub. Date: Mar. 7, 2002

(65) Prior Publication Data

US 2004/0035892 A1 Feb. 26, 2004

(30) Foreign Application Priority Data

Aug. 29, 2000 (DE) ..... 100 42 302

(51) Int. Cl.[7] ..... B65D 83/00

(52) U.S. Cl. ..... 222/402.11; 222/402.1; 222/153.11

(58) Field of Search ..... 222/402.1, 402.11, 222/402.13, 402.14, 402.15, 402.24, 153.1, 153.11, 153.01, 182, 394, 153.04; 239/337

(56) References Cited

U.S. PATENT DOCUMENTS

| | | | | | |
|---|---|---|---|---|---|
| 3,050,219 | A | * | 8/1962 | Sagarin et al. | 222/549 |
| 3,144,175 | A | * | 8/1964 | O'Donnell | 222/402.13 |
| 3,426,948 | A | * | 2/1969 | Stirling | 222/402.11 |
| 3,591,128 | A | * | 7/1971 | Ramis | 251/100 |
| 3,722,748 | A | * | 3/1973 | Wakeman et al. | 222/48 |
| 3,768,707 | A | * | 10/1973 | Nigro | 222/402.13 |
| 3,937,368 | A | * | 2/1976 | Hoagland | 222/402.11 |
| 4,024,988 | A | * | 5/1977 | Starrett | 222/153.11 |
| 4,187,963 | A | * | 2/1980 | Mascia | 222/402.13 |
| 4,449,647 | A | * | 5/1984 | Reed et al. | 222/153.09 |
| 5,154,323 | A | * | 10/1992 | Query et al. | 222/153.11 |

FOREIGN PATENT DOCUMENTS

| | | | | | |
|---|---|---|---|---|---|
| DE | 1868294 | U | * | 2/1963 | |
| DE | 29920994 | U1 | * | 1/2000 | B65D/83/22 |
| DE | 19927381 | A1 | * | 11/2000 | B65D/83/22 |
| EP | 0151973 | A2 | * | 1/1985 | B65D/83/14 |
| EP | WO-02018234 | A3 | * | 3/2002 | B65D/83/16 |
| FR | 2484962 | A | * | 12/1981 | B65D/83/14 |
| GB | 1463733 | A | * | 2/1977 | B65D/47/24 |

* cited by examiner

*Primary Examiner*—Frederick Nicolas
(74) *Attorney, Agent, or Firm*—Stites & Harbison PLLC; Douglas E. Jackson

(57) ABSTRACT

The spray can has a valve disk (12) with a valve, which valve disk is formed with a valve dome (16) and a fastening collar (18) surrounding it at a radial intermediate distance. The valve is actuated by pushing down a rotatable spray head (22) seated on a tappet (20). For obtaining turning stops for an actuating position and a closing position without taking special steps on the valve disk (12) or can body (10), it is provided that a stop ring (30) is arranged, fixed against relative rotation, in the annular space between the valve dome (16) and the collar (18). For being adaptable to materials of different thickness of the valve disk (12), it is formed with lamellas (35) at the outer circumference, is pushed with press fit into the collar (18) and has a cam track (36) with at least one recess extending along the circumference. The spray head (22) is formed or connected with at least one cam (46, 48). It acts together with turning stop faces (56) on the stop ring (30). Acting together with the cam track (36), it permits the spray head (22) to be pushed down only if the cam (46) is located above the recess.

11 Claims, 7 Drawing Sheets

Figure 5:
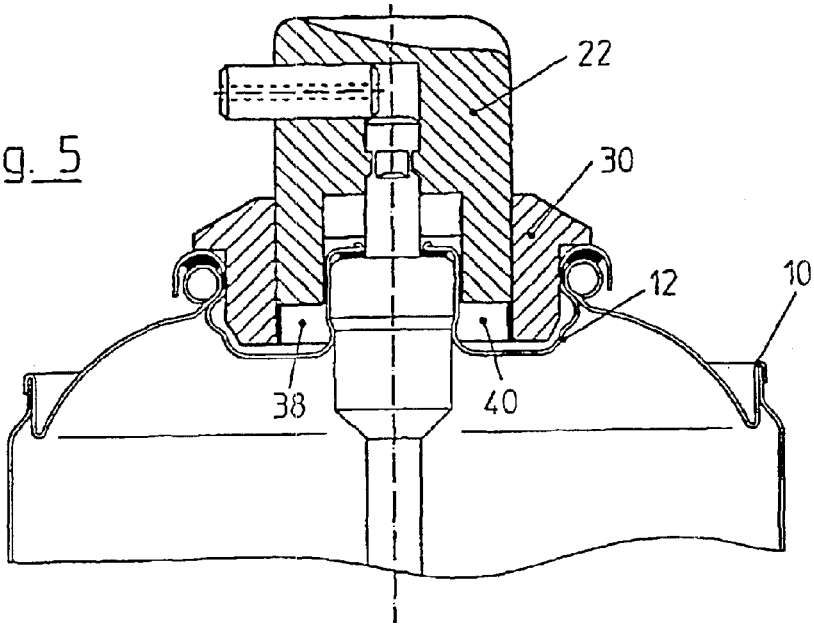

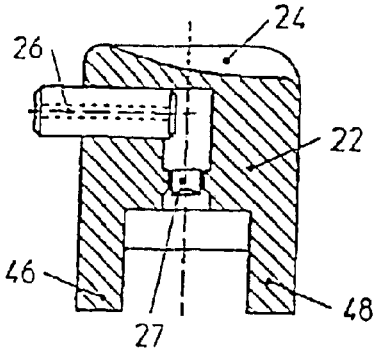
Fig. 1
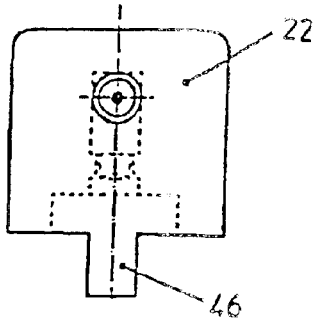
Fig. 2
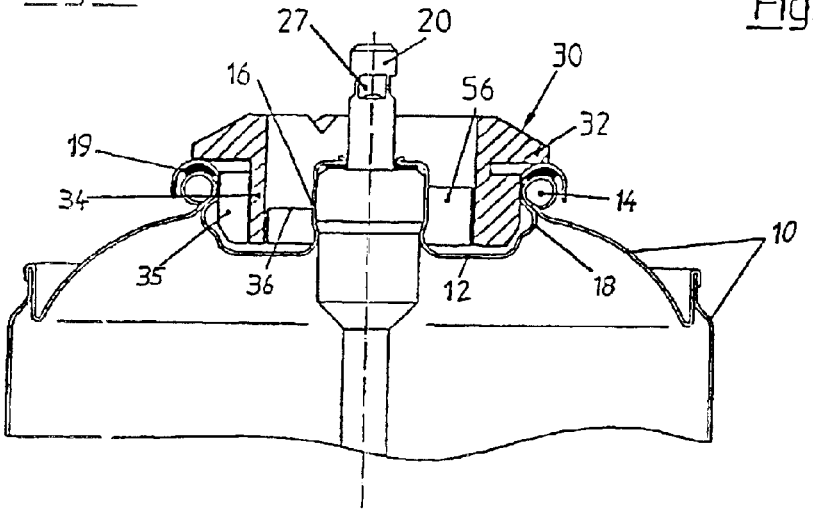
Fig. 3A
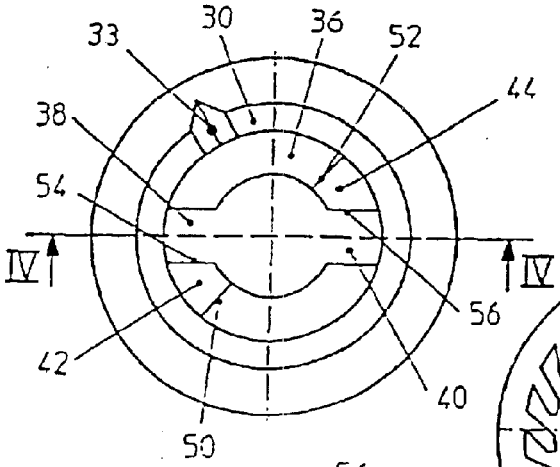
Fig. 3B
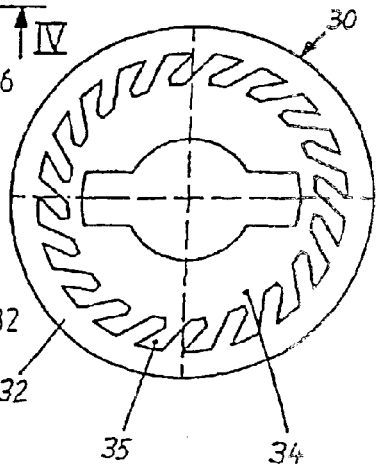
Fig. 4
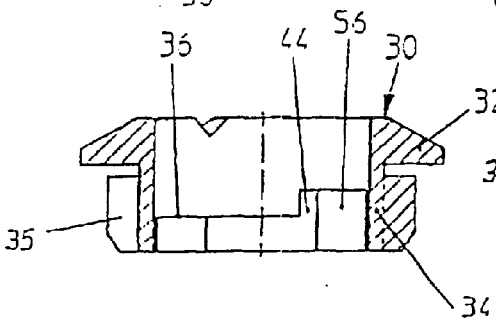

Fig. 11a
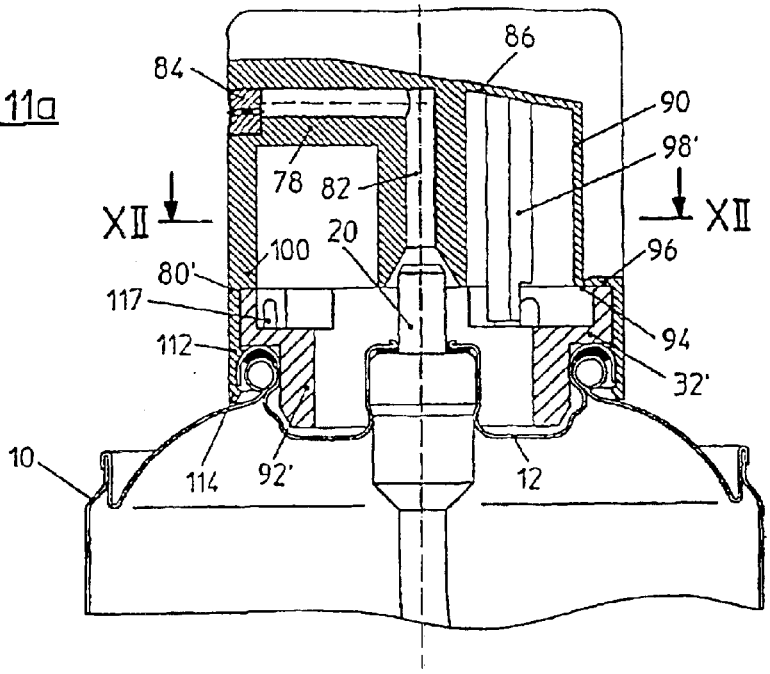
IX-IX
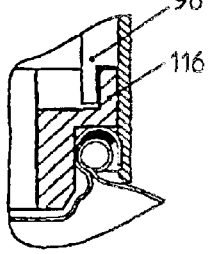
Fig. 12b
Fig. 12a
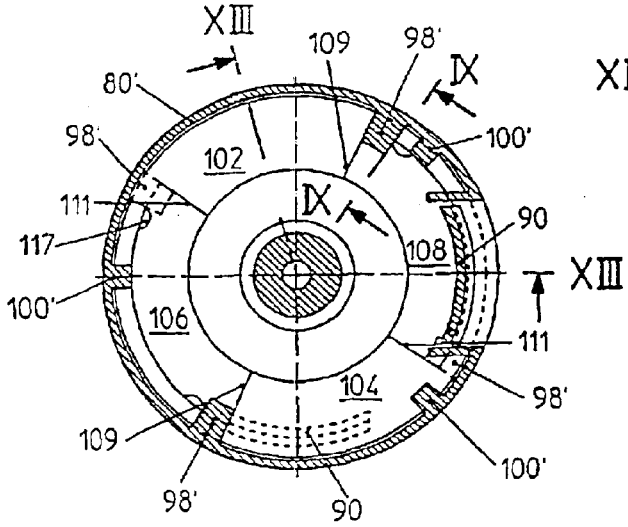
XII-XII
Fig. 13a
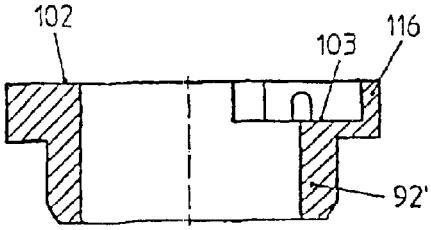
XIII-XIII

AEROSOL CAN

BACKGROUND OF THE INVENTION

The invention relates to a spray can with a valve disk with a valve, which is formed with a valve dome and a fastening collar surrounding the latter at a radial intermediate distance, as well as with a rotatable spray head, which can be placed on a tappet extending upward out of the valve dome and being axially movable for controlling the valve, and together with the latter must be pushed downward against a spring force from a closed position into a spraying position, wherein a stop ring has been pushed and is seated by press fit, fixed against relative rotation, in the collar (30, 92), on the upward pointing side of which a cam track, extending along the circumference, has been formed, over which, when the spray head is rotated into the closed position, one or several cams connected with it can be moved at a slight distance or slidingly, while at least one stop connected with it can be rotated back and forth between two stop faces extending transversely to the circumferential direction, and in one of the two end positions of the spray head determined by the stop faces the cam path is formed under the cam(s) by means of a recess which permits the spray head to be pushed down into the spray position.

Spray cans of this type are used in many applications. For example, substances for the care of the body, shoes, motor vehicles, or paints and foam sealing agents for construction purposes are sold in them. Usually the spray head can be pushed down in any angular position for opening the valve. So that this does not occur unintentionally, it is normally covered by a cap, which can be snapped into the upper rim of the can or of the disk, which must be removed before use and should be replaced thereafter. However, this is often forgotten, and just a moment of carelessness is sufficient to trigger a burst of spray.

For this reason it is already known to seat a ring, which is connected with the spray head and an actuating cap, in a manner fixed against relative rotation, on which a partially open cover cap is seated rotatable in a limited manner. In one of its end positions the actuating cap can be pushed down together with the integrated spray head and the valve can be actuated by means of this, in the other positions the actuating cap is prevented from movement in the axial direction. However, in this case the actuating cap must be made of a suitable resilient material and be designed in such a way that a portion of it can be pushed down together with the spray head.

In connection with spray cans with a cover cap which is rotatable in a limited manner, it is necessary to take special steps in connection with the otherwise evenly round upper can rim for fixing the stops for limiting the rotating movement of this cap in a defined circumferential position. To this end it is known from DE 298 19 515 U1 to provide the outermost edge of the valve disk with teeth or beads, which are intended to prevent a ring from rotating, which is later placed on the can, is connected with the spray head, and on which the cover cap is rotatably seated, and which is embodied with turning stops.

As an alternative, a spray can of the type mentioned at the outset is known from Utility Model 1 168 294. There, a stop ring is fastened by means of a press or clamped fit in the valve disk depression or on the valve dome. This type of fastening of a massive ring presumes a very accurately sized inner diameter of the collar of the valve disk for assembly, and permanently dependable seating. However, this is to a great extent a function of the thickness of the valve materials. For example, tin plate, bare or lacquered, has a thickness of 0.28 mm, tin plate with a PP coating has a thickness of 0.48 mm, and lacquered aluminum is 0.42 mm thick. The mentioned three materials alone already result in inner diameters of the collar of the valve disk of 24.66, or 24.26, or 24.38 mm diameter in a conventional spray can. Therefore, in the structure in accordance with Utility Model 1 168 294 a special stop ring is required for each one of the three mentioned material thicknesses, whose outer diameter would have to be matched to the respectively different inner diameter of the collar.

The object of the invention is based on providing a spray can having the mentioned safety feature, which does not require any special steps in manufacturing the valve disk or the can body for obtaining fixed turning stops, and allows the use of the same stop ring, regardless of the thickness of the material of the valve disk.

The above object is attained in accordance with the invention in that the outer circumferential face of the stop ring, which constitutes the press fit, has a plurality of radially elastically yielding lamellas which rest against the collar.

The proposed spray can has the advantage that, after the valve disk has been fastened by cramping it on the flanged rim of the opening of the can body, the stop ring can be simply and dependably fixed in place pushing it into the annular space between the valve dome and the collar in such a way that it rests with a solid press fit against the collar and/or the dome. Thus it is not necessary to produce specially designed valve disks for such spray cans with safety functions. The press fit of the stop ring on the collar can easily be embodied in such a way that by this alone a very strong holding moment is achieved.

Moreover, the embodiment of the outer circumferential surface of the stop ring with lamellas allows the adaptation to different inner diameters of the collar of the valve disk. A single stop ring for all customary material thicknesses of the valve disk is therefore sufficient.

In the preferred embodiment, the lamellas extend outward from their origin at an acute angle to the respective radial direction. In this way the lamellas are primarily stressed for bending in the press fit and are not merely radially upset. The adaptation to the different inner diameters of the collar is provided by a more or less strong bending of the lamellas.

Otherwise the stop ring cooperates in a known manner with the spray head. Thus, a special design and seating of a cover cap is not important for the desired safety function. The safety function can also be provided without the cap. If a cap is provided for visual reasons, or because a cap with a larger diameter can be more easily rotated during manipulation than a small spray head, it can be designed and seated in a variety of ways. For example, there is the possibility of employing caps which are seated so they can be axially displaced in a limited way or are partially elastically deformable, which are seated and guided, for example, on the outer rim of the valve disk, on the stop ring or on the can body. Alternatively it is also possible to shape the cap in one piece with the spray head, or to fixedly connect it with it, so that it does not necessarily require a special seating on the valve disk or the can body. In connection with a still further alternative embodiment a cap, which is only connected with the spray head in a manner fixed against relative rotation, has an upper opening, through which the spray head can be pushed.

Figure 6:
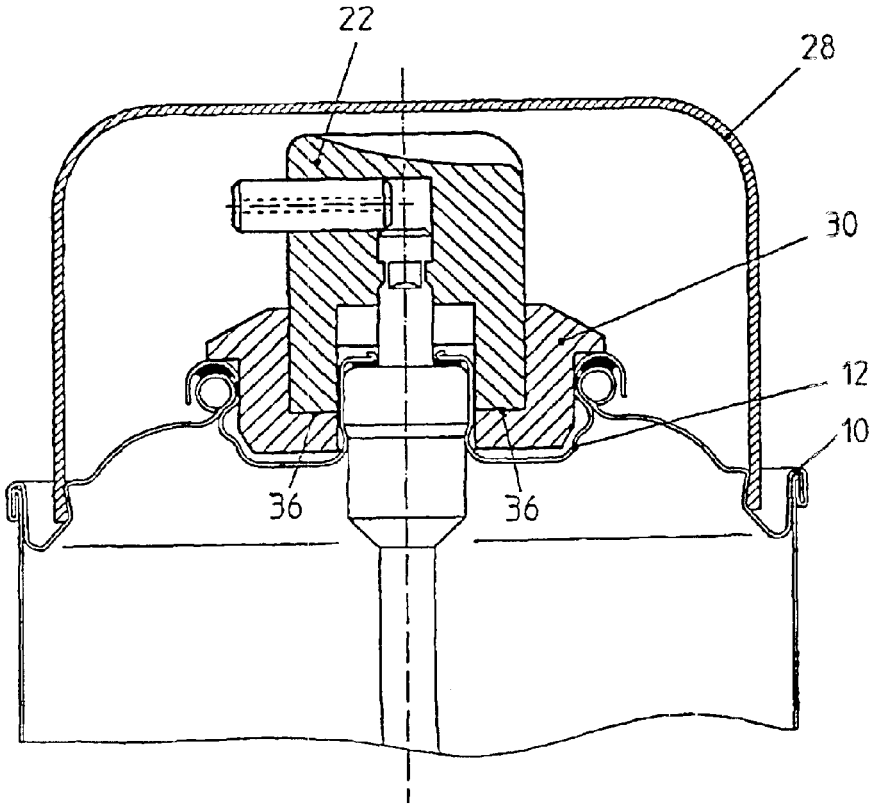
Figure 7:
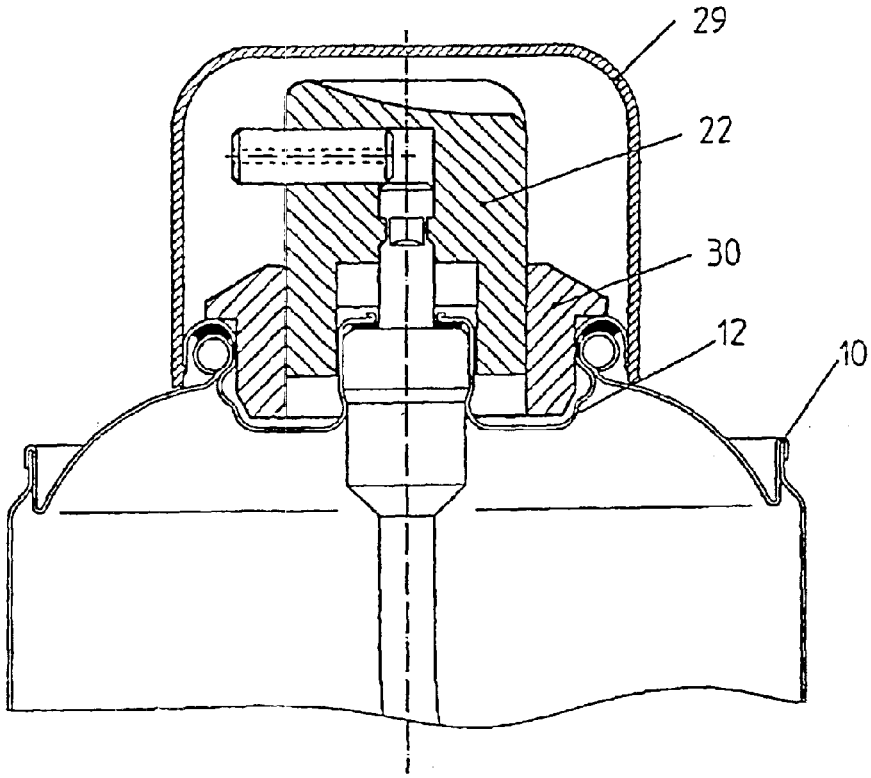
Figure 13:
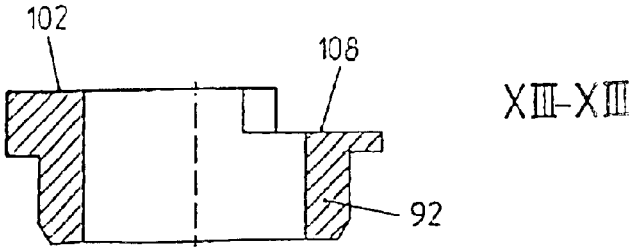
Figure 14:
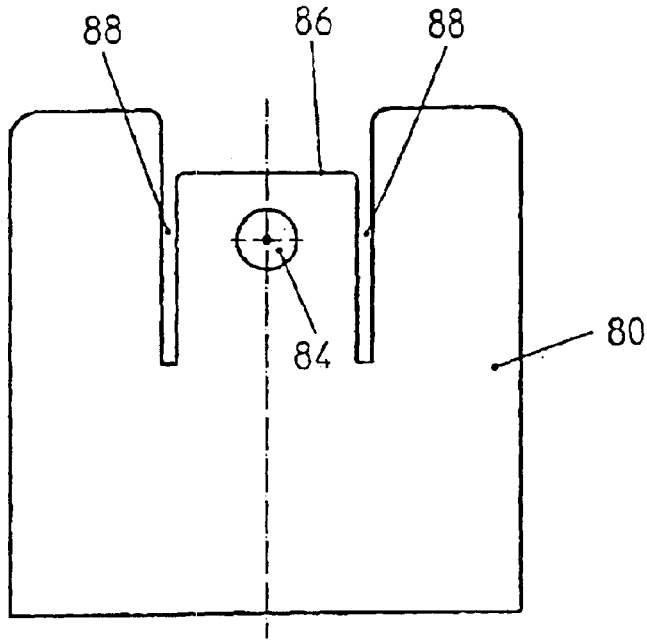
Figure 15:
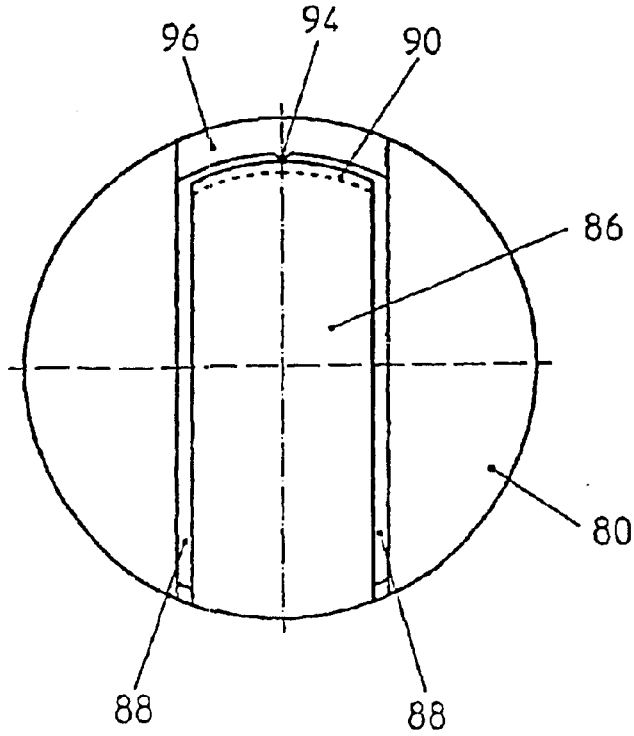

Exemplary embodiments of the invention will be described in greater detail in what follows by means of the drawings. Shown are in:

FIG. 1, a vertical cross section through the upper area of the spray can, wherein the spray head is separately shown for reasons of an improved graphic representation, FIG. 2, a plan view, turned by 90°, of the spray head in FIG. 1, FIG. 3A, a view from above on the stop ring represented in FIG. 1, which has been pressed into the annular space of the valve disk of the spray can, FIG. 3B, a plan view from below of the stop ring in FIG. 3A, FIG. 4, an axial longitudinal section through the stop ring along the section line IV—IV in FIG. 3A, FIG. 5, a plan view of the upper portion of the spray can in FIG. 1 following the mounting of the spray head, wherein the representation of the lamellas has been omitted here and in what follows, FIG. 6, a plan view of the upper portion of the spray can in FIGS. 1 and 5 with a releasable cap placed on it, FIG. 7, a further exemplary embodiment, wherein the spray can in accordance with FIG. 1 is provided with a cap held on the edge of the valve disk, FIG. 8, a spray can with a spray head, which can be actuated through an upper opening in a cap maintained on the disk edge, FIG. 9, a cap, whose shape and holding has been altered in comparison with FIG. 8, FIG. 10, a cap, whose connection with the can body and the spray head has been modified in comparison with the cap in FIG. 8, FIG. 11, an exemplary embodiment of a spray can, wherein the spray head is formed in one piece with the cap, FIG. 11*a*, a modification of the embodiment in FIG. 11, FIG. 12, a cross section through the cap along the section line XII—XII in FIG. 11, FIG. 12*a*, a cross section through the cap along the section line XII—XII in FIG. 11*a*, FIG. 12*b*, a partial section along the section line IX—IX in FIG. 12*a*, FIG. 13, an axial section along the section line XIII—XIII in FIG. 12 through the stop ring used in the embodiment in accordance with FIGS. 11 and 12, wherein the representation of the lamellas was also omitted, FIG. 13*a*, an axial section along the section line XIII—XIII in FIG. 12*a* through the stop ring used in the embodiment in accordance with FIGS. 11*a* and 12*a*, but without representing the lamellas, FIG. 14, a plan view from the left on the cap represented in FIG. 11, and FIG. 15, a view from above on the cap in FIGS. 11 and 14.

DETAILED DESCRIPTION OF THE INVENTION

The upper portion of a spray can, whose body is identified by 10 and whose valve disk by 12, is represented in FIG. 1. It is of no importance to the invention whether the can body was made in several parts of tin plate or in one piece of an aluminum alloy. In both cases the container opening, which is provided with a flange 14, is sealed by means of an appropriate valve disk 12 fastened on it, which has been designed in the customary way with a valve dome 16 in its center area and with a collar 18 extending concentrically around the dome in its radially outer area. The valve dome 16 contains parts of the spray valve, while the collar 18 has been fastened on the flanged rim 14 of the can body 10 by cramping, wherein a seal ring 19, or a sealing material laminated on it, provides tight closing.

A tappet 20 extends upward out of the valve dome which, on one hand, is the actuating tappet of the spray valve in the dome 16 and, on the other hand, constitutes the outlet conduit for the fluid to be sprayed. Since for operating the valve it would be difficult and painful to push on the comparatively slim tappet 20 down with a finger, a spray head 22 has been placed on it in the customary manner. It normally constitutes a comparatively large upper pressure surface 24, which slightly falls away toward one side, and is provided with a radially projecting spray nozzle 26, through which the fluid to be sprayed exits in the form of a spray jet. The spray head 22 can be axially maintained on the tappet 20, for example by means of a press fit, or by means of snapping together of projections and indentations 27, and is usually rotatable together with the tappet in relation to the can body 10.

So far, as described above, the represented spray can represents the customary prior art. Moreover, a cap 28 or 29, represented in FIGS. 6 and 7, is usually provided, which is to be snapped, easily releasable, onto the can body 10, or the outer edge of the valve disk 12, covers the spray head 22 when it is moved or stored, and must be removed prior to using the spray can.

The special feature of the represented spray can is the stop ring 30, which can preferably be made of plastic, but possibly also of metal, and is inserted into the annular space between the valve disk 16 and the collar 18. It is connected in a manner fixed against relative rotation with the valve disk 16. To this end it could for example be glued in the annular space. However, preferably it is simply fixed in place in the annular space of the valve disk 12 in that it is pressed into the collar with its outer diameter, which is of a slightly greater size than the inner diameter of the collar 18 and is designed to be radially elastically yielding by means of grooves, or lamellas 35, and is then maintained axially, as well as fixed against relative rotation, by means of the press fit created in this way. Alternatively or additionally it is also possible to provide a fixed contact with the outer wall of the valve dome 16. In all cases, as represented in FIG. 3B, the lamellas 35 do not extend exactly radially outward, but with a directional component in the circumferential direction. However, it is also possible to use comparatively thin and essentially radially oriented lamellas.

An outer flange 32 has been formed on the upper end of the stop ring 30 represented in the exemplary embodiment, whose lower surface can be flat or matched to the curvature of the edge of the valve disk 12 fastened on the flanged rim 14. In this way a stop is provided for pressing the stop ring 30 into the collar 18, as well as an exactly defined axial position of the stop ring 30 in respect to the valve dome 16 and the tappet 20. A marking or a groove 33 applied to the circumference is used as an alignment aid during assembly.

The stop ring 30 is arranged as a closed, annularly circulating and radially outer support element 34, on which the flange 32 is formed on the outside at the top, and at the bottom the lamellas 35 on the outside and a cam track, identified by 36 in FIG. 3, on the inside. It also extends in a circular shape around the center axis of the stop ring 30, however, is not embodied as a closed ring, but has two diametrically opposite recesses 38, 40, for example in the form of openings, or also only in the form of depressions. Viewed in a clockwise direction, step-like bumps or humps 42 and 44 have been formed in front of the recesses 38, 40 on the cam track 36 in FIG. 3. Their front and rear end faces, viewed in the direction of rotation, constitute turning stops or stop faces for two stops in the shape of cams 46 and 48, which are formed diametrically opposite each other in the outer radial area on the underside of the spray head 22 and project axially downward. These cams have a height of 6.3 mm, for example. The cam track 36 has a distance of 8 mm from the upper edge of the stop ring 30, while the distance of the humps 42 and 44, measured from there, is 6 mm, for example, see FIG. 4.

In the course of assembly, following the pressing-in of the stop ring 30, the spray head 22 is placed on the tappet 20 in such a position that in the closed position of the valve the cams 46, 48 are located at a short distance above the cam track 36. The latter constitutes an axial stop which prevents the spray head from being pushed down and the spray valve from being opened by this. If, making reference to FIG. 3, the spray head is rotated in a clockwise direction, the cams 46 and 48 bump against the front stop faces 50 and 52, viewed in the clockwise direction, of the humps 42 and 44. The spray head cannot be turned further in a clockwise direction, and in this end position the cam track 36 located underneath the cam 46, 48 also prevents the pushing-down and actuation of the spray valve. But if the spray head is rotated in a counterclockwise direction, for example by approximately 90° to 150°, depending on the width of the cams 46, 48 and humps 42, 44, the cams 46, 48 bump against the rear stop faces 54 and 56, viewed in the clockwise direction, of the humps 42 and 44. Next to these stop faces, the approximately 3.5 mm wide recesses 38 and 40 are now located under the approximately 3 mm wide cams 46, 48 (see FIG. 2), so that in this position—and only in this position—the spray head can be pushed down for opening the spray valve.

As can be seen, the cam track 36 with its two humps 42 and 44 thus constitutes an axial stop, which is only interrupted in a defined relative angle of rotation position and which prevents the spray head from being pushed down, as well as two turning stops, which are located far apart on the circumference and define, on the one hand, a secured position of rest and, on the other hand, a "non-secured" ready position, in which a spray jet is triggered by pushing the spray head down. It is sufficient if, after using the spray head, the user again rotates the spray head in a clockwise direction against the stop faces 50, 52 in order to secure the closure again, so that a spray jet is not unintentionally triggered when a pressure is accidentally applied to the spray head.

Since the said safety function is independent of the presence and type and embodiment of a cap, there is a large amount of freedom of design, if such is desired. In a preferred embodiment in accordance with FIG. 8 the cap, which is identified by 58 there, cannot be removed by the user, but is snapped behind the outer edge of the valve disk 12 and can be rotated against a slight resistance. On its top, the cap 58 has an access opening 60, through which it is possible to push down on the spray head 22, whose top in this case is suitably not inclined on one side, but is designed to be flat or slightly arched, for example. To avoid sharp edges, and for obtaining an additional radial guidance for the spray head 22, a collar 64, pointing inward, or downward, is formed on the cap 58 around the access opening 60, and is provided at one location of its circumference with a slit 66, through which the spray nozzle 26 of the spray head extends. Because of the engagement of the spray nozzle 26 with the slit 66, the cap 58 is connected, fixed against relative rotation, with the spray head 22. An opening 68, through which the spray jet exits from the cap 58, is located in radial alignment with the slit 66 in the outer wall of the cap 58.

Figure 8:
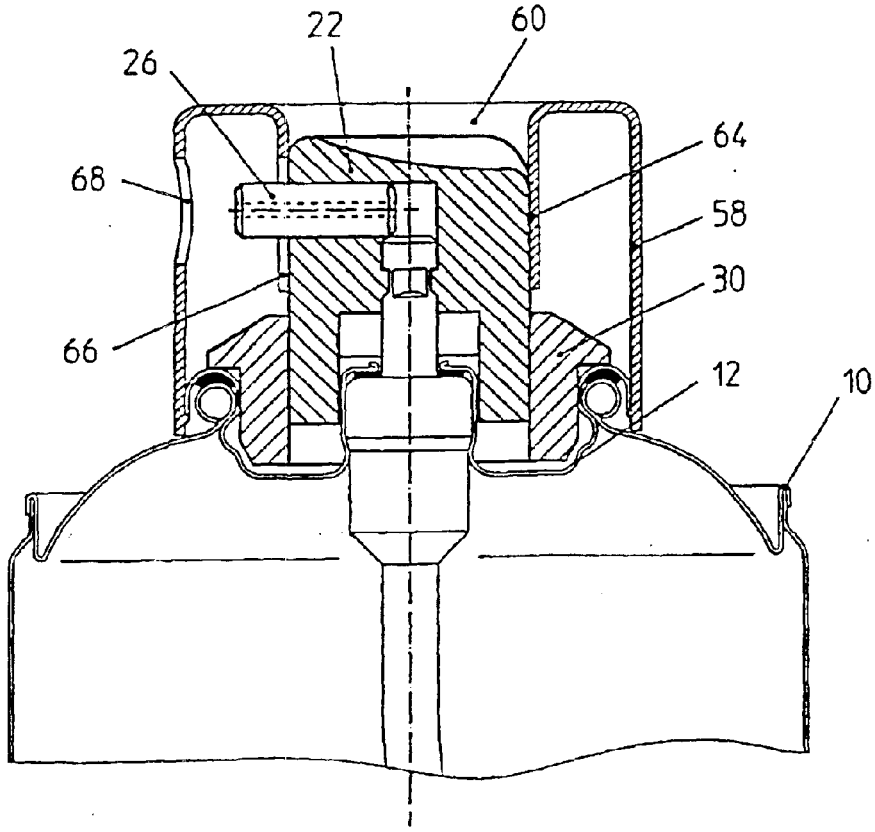
Figure 9:
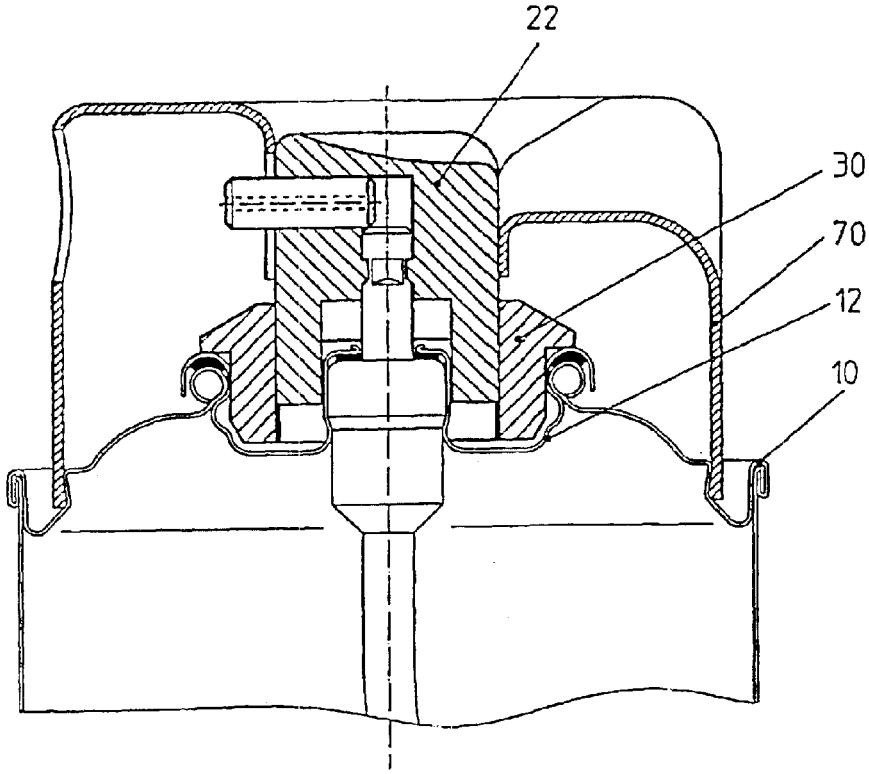

The embodiment in accordance with FIG. 9 differs from the one in FIG. 8 only in that a cap, which is snapped in at the lower end of the can cone, but is still rotatable, is used, on which a depression, which is at least the width of a finger and drops down toward the outer circumference, is formed at the top at a place of its circumference. Because of this the spray head becomes easier to access. In this case its top can again be slightly inclined. However, in both cases the upper edge of the spray head is located lower than the upper edge of the cap, by which a further protection against an unintended actuation of the valve is achieved.

Figure 10:
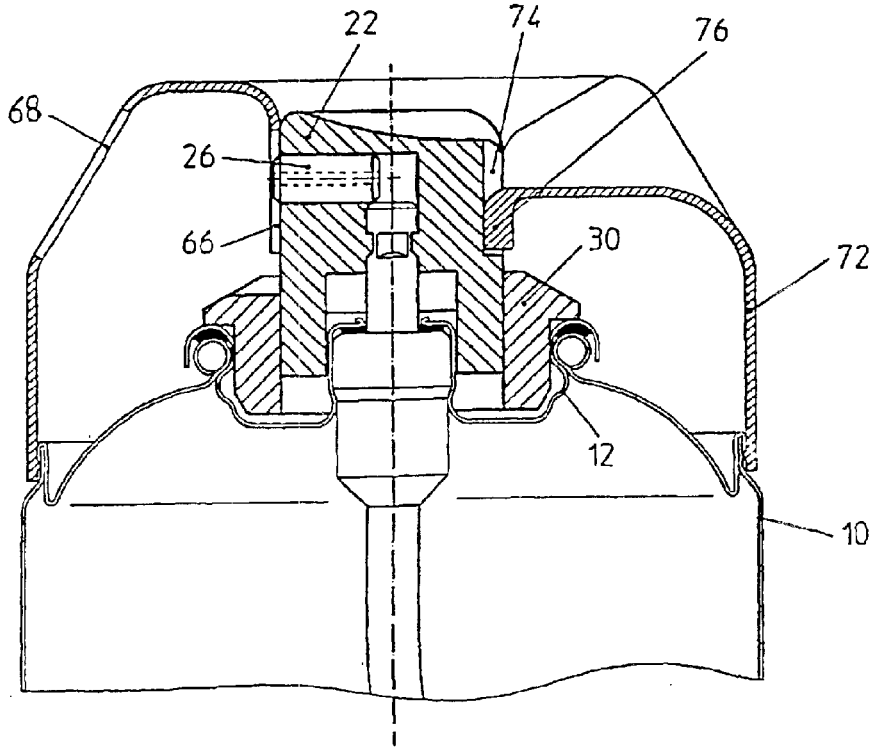

Externally, the embodiment in accordance with FIG. 10 hardly differs from the one in accordance with FIG. 9. The cap, identified by 72, is seated on the outside on the seam between the can body and the can cone in an axially fixed, but rotatable manner. The special feature in comparison with the embodiment in accordance with FIG. 9 lies in that in the case of this example the spray head 22 is provided with three axial grooves 74 on the outer circumference, which are engaged by ribs 76, which are formed on the collar constituting the access opening and project radially inward. Together with the grooves 74 they constitute a tongue-and-groove connection, which is fixed against relative rotation, but allows the pushing-down of the spray head 22. It is therefore not necessary to use a spray nozzle protruding from the spray head in order to take the spray head 22 along when the cap is rotated.

The spray can represented in FIGS. 11 to 15 has a spray head 78, which is embodied in one piece with a cap 80, which is seated by being snapped into the outer edge of the valve disk 12. The spray head 78 has an outlet conduit 82 extending at right angles, which leads to a spray nozzle 84 seated in the outer wall of the cap 80. In the closed position, the tappet 20 of the valve projects into a cone at the lower end of the outlet conduit 82 of the spray head 78. However, in the closed position there is no sealed connection between the tappet 20 and the spray head 78. Only when the spray head is depressed by hand does it become seated with a sealed contact of the tappet 20, whose free end is preferably provided with a cone matching the cone on the outlet conduit 82.

Since the lower area of the cap 80, which is formed in one piece with the spray head 78, is seated axially fixed, its area making a transition into the spray head 78 must be designed to yield axially, so that first, by means of a manual pressure on the transition area from above, the spray head 78 is caused to be sealingly seated on the tappet 20, and can then be pushed down together with it until the valve opens.

The transition area between the cap 80, which is also formed with a depression approximately the width of a finger (see FIG. 14), the same as in the exemplary embodiments in FIGS. 9 and 10, and the spray head 87 consists of a strip 86 constituting the bottom of the depression, which is separated on both sides from the remaining part of the cap 80 by a slit 88. The portion of the circumferential wall of the cap 80 containing the spray nozzle 84 is also a part of the strip 86 delimited by the lateral slits 88. In this way the slits only extend to approximately half the height of the cap (see FIG. 14). On the diametrically opposite side the cap 80 is radially recessed. A vertical leg of the strip 86, identified by 90, extends between the slits 88 from the top to almost the level of the upper edge of a stop ring 92, which in its function and with nonrepresented lamellas 35, corresponds to the stop ring 30, but has a somewhat different shape, which will be discussed in what follows.

The vertical leg 90 of the strip 86 is connected at its lower end via a predetermined breaking point 94 with a step-shaped section 96 of the cap 80, which represents the transition from the vertical leg 90 to the outer diameter of the cap. In the course of the first actuation of the valve by pressure from the top on its leg 86, which descends obliquely in the direction of its vertical leg 90, the predetermined breaking point 94 is broken, and then the strip 86, together with the spray head 78, is pivoted around the lower area of the strip 86 represented in FIG. 14 on the side of the cap located diametrically opposite the predetermined breaking point 94. The pivoting movement is limited by the vertical leg 90 of the strip 86 hitting the top of the stop ring 92. In the embodiment in accordance with FIGS. 11 to 15, the vertical leg 90, which is connected in one piece with the spray head 78, therefore forms a cam which, acting together with the stop ring 92, blocks or releases the downward pushing of the spray head 78. In this respect it corresponds to the cams 46 and 48.

However, differently from the cams 46 and 48, the cam 90 does not perform the function of a turning stop. For that purpose, two vertical ribs 98 are provided, which are essentially located diametrically opposite each other and project radially inward. They could also be replaced by two oppositely located, axially short protrusions, provided that by their arrangement near the lower end of the cap 78 it is assured that the vertical ribs 98, or the short protrusions, can act together with stop faces on the stop ring 92 for limiting the rotary movement of the cap 78.

Figure 12:
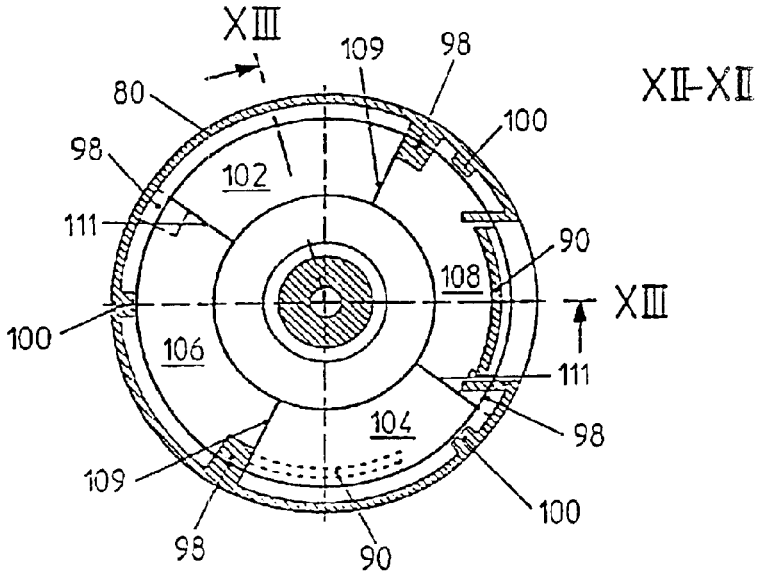

As can be seen in FIG. 12, not only are stops 98 formed on the inside of the circumferential wall of the cap 78, but also several ribs 100, evenly distributed over the circumference which, on the one hand, reinforce the comparatively thin wall of the cap and, on the other hand, come to rest on the top of the disk edge and there absorb axial forces acting on the cap from above.

Outside of the central bore, the top of the stop ring 92, which is fixed on the disk edge by press fit in the same way as the stop ring 30, is designed with two oppositely located higher areas, whose upper surfaces are identified by 102 and 104 in FIG. 12, as well as two lower areas 106 and 108. All four areas can extend over approximately 90° at the circumference of the stop ring. However, either the higher or lower areas can be selected to be somewhat larger than the respectively other areas.

As FIG. 12 illustrates, the ribs 98 used as stops extend from the circumferential wall of the cap 80 inward to such an extent that, when the cap is rotated back and forth, they hit against the vertical border surfaces between the higher and lower circumferential areas of the stop ring 92, which respectively constitute two stop faces 109 and 111. Therefore the cap can only be rotated back and forth by approximately 90°. As can also be seen in FIG. 12, the vertical leg 90 of the strip 86 used as a cam is located on a radius which is less than half the outer diameter of the stop ring 92. The result of this is that in the relative angle of rotation position of the parts represented in FIG. 12, the cam 90 can be pressed down onto the upper face of the lower area 108 of the stop ring 92, and that the valve can be opened in the process. But if the cap 80 is rotated by approximately 90° in a clockwise direction, a relative position of the parts results, in which the turning stops 98 and the cam 90 are in the position indicated by dashed lines in FIG. 12. This is the position in which it can be moved and in which the spray head 78 is blocked against being pushed down, because the cam 90 is located above the high section 104 of the stop ring 92 and is therefore prevented from making a downward movement.

As with the stop ring 30, the higher and lower circumferential sections 102 to 108 of the stop ring 92 form a cam track which, in the embodiment of FIGS. 11 to 15, must be provided in the radially outer area of the upper face of the stop ring 92, since the cam 90 and the stops 98 are also located radially on the outside of the circumferential wall of the cap 80. It is understood that the exemplary embodiment in accordance with FIGS. 11 to 15 could also be altered in such a way that either a cam, whose function corresponds to the stops 98, and/or one or several stops, whose functions correspond to the cam 90, are formed on the spray head 78. In this case the cam track would have to lie on a smaller radius, just as with the stop ring 30.

The modification of the above described spray nozzle in accordance with FIGS. 11 to 15, represented in FIGS. 11*a*, 12*a*, 12*b* and 13*a*, has the special feature that the stop ring, identified by 92' in the modification, has been preassembled with the cap 80', and the unit produced in this way can be delivered in a finished state and, following the filling of the spray can, can be placed on the latter in a single simple mounting process.

For the said purpose, in the modified embodiment the flange 32' of the stop ring 92' is axially enlarged, so that the height of its cylindrical circumferential face is at least half as high as the remaining length of the stop ring 92', for example it can also be ⅔ of the latter. Furthermore, in comparison with the embodiment in FIG. 11, in the one in FIG. 11*a* the outer diameter of the flange 32' has been enlarged to approximately the outer diameter of the valve disk 12. In this case the modified cap 80' can be of the same size as in the embodiment in FIG. 11. Only an adaptation of the lower ends of the ribs 98 and 100 to the larger flange 32' is required. The latter still has the depressions 106, 108. However, for obtaining a comparatively large circumferential surface as the contact and guide surface for the cap 80', the recesses 106, 108 are embodied as depressions in the flange 32', i.e. they are surrounded by an edge collar 116. The ribs 100 are now supported on the outer edge, or the edge collar 32' of the stop ring 92', instead of on the outer edge of the valve disk 12. In accordance with FIG. 12*b*, the ribs 98' are notched in the area of the collar 116, so that they perform the above described stop function with their radially inner, lowermost area, which protrudes into the respective recess 106 or 108. Otherwise the stop ring 92' is also embodied with lamellas 35, not represented.

In a further preferred design of the modified embodiment in accordance with FIG. 11*a*, small, radially inward pointing protrusions 117 are formed on the radially inner circumferential wall of the collar 116 at a distance in front of the stop faces 109 and 111 corresponding to the width of the ribs 98'. In the course of turning the cap 80', the lower ends of the ribs 98' overcome these lower protrusions 117 and snap in behind them. In this way it is achieved that the rotatable cap 80' is secured in both its end positions by the protrusions 117. Only after a defined torque has been exerted on the cap 80', is the resistance offered by the protrusion 117 overcome and the cap can then be further turned into the respectively other end position. A corresponding securing by snapping into the end positions is also possible with the previously described embodiments.

In the exemplary embodiment, the axial securing of the cap 80' on the stop ring 92' is assured by an annular rib 112 formed in its lower area on its inner wall, which during preassembly of the two parts snaps behind the lower edge of the flange 32'. It is understood that several protrusions can be provided in place of the annular rib 112, and that snapping into an annular groove in the edge collar 116, or a reversed protrusion/groove arrangement can be used as alternatives. When assembling the unit consisting of the cap 80' and the stop ring 92' on the can body, the annular rib 112 can find a space in the annular gap between the downward bent outer area of the valve disk 12 and the flange 32'.

A further inner annular rib 114 is provided on the lowermost end of the cap 80'. In the course of mounting the unit consisting of the cap 80' and the stop ring 92' on the can body, it snaps in behind the outermost edge of the valve disk 12 and forms a positive axial security for the connection of these parts.

Figure 11:
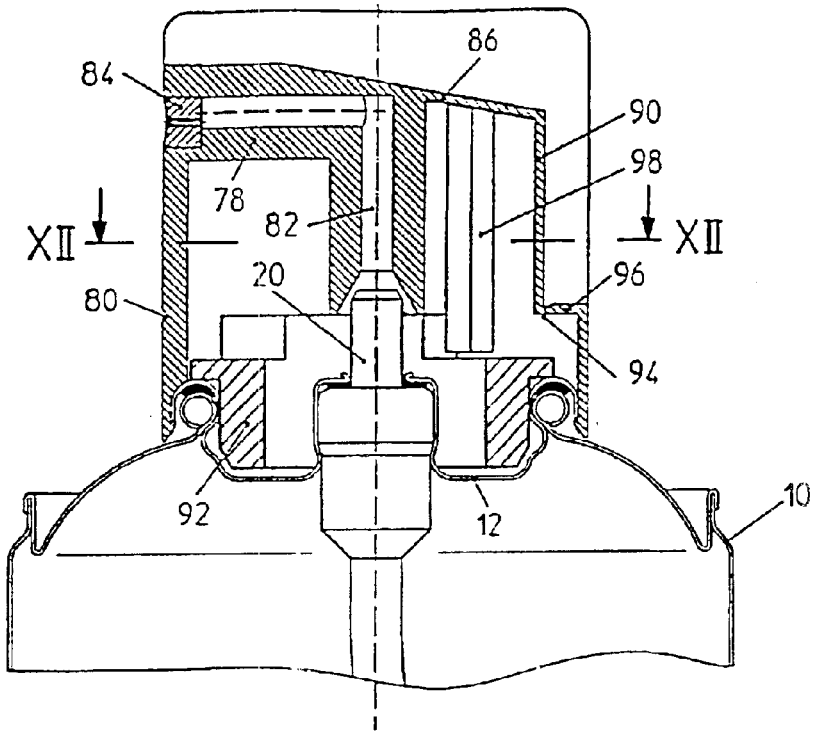

The principle of a preassembly of the stop ring and of a cap in which the spray head is integrated is represented by means of an exemplary embodiment in FIG. 11, or 11*a*. Differing from this concrete design it can be seen that an enlargement of the outer diameter of the stop ring is not a necessary requirement for this. Preassembly, for example by means of snap-in members, can also be achieved if the outer diameter of the stop ring is greater or smaller than the outer diameter of the valve disk 12.

What is claimed is:

1. A spray can having a valve disk with a valve, which said valve disk is formed with a valve dome and a collar surrounding the dome at a radial intermediate distance and being fixed on a flanged rim of the can body by cramping, as well as having a rotatable spray head, which can be placed on a tappet extending upward out of the valve dome and which is axially movable for controlling the valve, and which together with the valve must be pushed downward against a spring force from a closed position into a spraying position, wherein a stop ring has been pushed and is seated by press fit, fixed against relative rotation, in the space between the valve dome and the collar, on the upward pointing side of which said stop ring a cam track, extending along the circumference, has been formed, over which, when the spray head is rotated into the closed position, one or several cams connected with said spray head can be moved at a slight distance or slidingly, while at least one stop connected with said spray head can be rotated back and forth between two stop faces extending transversely to the circumferential direction, and in one of the two end positions of the spray head determined by the stop faces the cam path is formed under the cam(s) with a recess which permits the spray head to be pushed down into the spraying position, characterized in that the circumferential surface of the stop ring providing the press fit has a plurality of radially elastically yielding lamellas, which, starting from origins thereof protrude obliquely at an acute angle to the radial direction and with end edges thereof rest against at least one of the collar or the valve dome.

2. The spray can in accordance with claim 1, characterized in that there are provided two cams, which are arranged diametrically opposite each other, and on the cam track two stop faces for each cam, which is simultaneously used as a stop, and a recess.

3. The spray can in accordance with claim 1, characterized in that the end edges of the lamellas essentially extend parallel with the center longitudinal axis of the stop ring.

4. The spray can in accordance with claim 1, characterized in that the stop ring is formed with an outer circumferential or interrupted flange which, in the course of the stop ring being pressed in, comes to rest on the upper edge area of the valve disk.

5. The spray can in accordance with claim 4, characterized in that the outer diameter of the flange of the stop ring is of the approximate size of the outer diameter of the valve disk, and that the cap can be preassembled by being axially snapped onto the outer circumferential surface of the flange in an axially fixed, but rotatable manner.

6. The spray can in accordance with claim 5, characterized in that the cam is a radially recessed, axially elastically yielding part of the circumferential wall of the cap, which can be pushed down together with the spray head, and that one or several stops in the form of inner protrusions on the axially fixed part of the circumferential wall of the cap act together with stop faces formed by surfaces which border respectively one recess in the cam track in the circumferential direction, wherein the relative arrangement of the cam, the stop and the recess at the circumference has been made in such a way that in the one stop position the cam is located above a high section of the cam track, and in the other stop position above a recess.

7. The spray can in accordance with claim 5, characterized in that in the assembled state an inner protrusion of the cap engages an outer annular groove in the stop ring or an outer annular gap between the stop ring and the outer area of the valve disk.

8. The spray can in accordance with claim 7, characterized in that the cap can be axially snapped with a further inner protrusion behind the outer edge of the valve disk.

9. The spray can in accordance with claim 5, characterized in that the height of the outer circumferential surface of the stop ring, over which the cap extends and by which said cap is guided, is at least half as great as the height of a remaining outer circumferential surface.

10. The spray can in accordance with claim 9, characterized in that the flange of the stop ring is formed with a collar, which guides a portion of the cap, constitutes the outer circumferential surface, and axially surrounds the recesses on the outside.

11. The spray can in accordance with claim 5, characterized in that snap-in protrusions are formed on the stop ring at a defined distance in front of the stop faces, which act together with the stops and, by means of a defined moment of friction, which must be overcome, secure the spray head, or the cap in the end positions against unintentional turning.

* * * * *